US006206751B1

(12) United States Patent
Lee

(10) Patent No.: US 6,206,751 B1
(45) Date of Patent: Mar. 27, 2001

(54) TOY VEHICLE WITH MOTOR-DRIVEN AND FREE-WHEELING MODES OF USE

(75) Inventor: Keung Lee, New Territories (HK)

(73) Assignee: New Bright Industrial Co., Ltd., Hong Kong (HK)

( * ) Notice: Subject to any disclaimer, the term of this patent is extended or adjusted under 35 U.S.C. 154(b) by 0 days.

(21) Appl. No.: 09/357,812

(22) Filed: Jul. 20, 1999

(51) Int. Cl.[7] ..... A63H 17/00

(52) U.S. Cl. ..... 446/431; 446/461; 446/462; 446/463

(58) Field of Search ..... 446/461, 462, 446/463, 451, 431; 463/62, 63

(56) References Cited

U.S. PATENT DOCUMENTS 4,135,328 * 1/1979 Yamasaki ..... 446/463
4,306,375 * 12/1981 Goldfarb et al. ..... 446/463
4,511,343 * 4/1985 Goldfarb et al. ..... 446/463
4,540,380 * 9/1985 Kennedy et al. ..... 446/463
4,573,943 * 3/1986 Kennedy et al. ..... 446/463
4,850,931 * 7/1989 Auer ..... 446/437
5,924,909 * 7/1999 Yamakawa ..... 446/442

* cited by examiner

*Primary Examiner*—Jacob K. Ackun
*Assistant Examiner*—K Fernstrom
(74) *Attorney, Agent, or Firm*—Nixon & Vanderhye PC

(57) ABSTRACT

A toy vehicle is provided that is adapted for motor driven, battery powered operation, and in which the wheels can be disengaged from their gear train to permit free-wheeling use. The gear train for transmitting rotation from the motor drive shaft to the axle includes a worm gear mounted to the axle. The worm gear can be axially shifted along the axle with a manually manipulatable switch to engage and disengage the axle from the gear train. The switch preferably also controls transmission of electric power to the motor. In a presently preferred embodiment, electrical powers transmitted from the battery compartment to the motor solely by suitably disposed contact plates and, thus, is a "'no wire' design".

18 Claims, 7 Drawing Sheets

Fig. 9
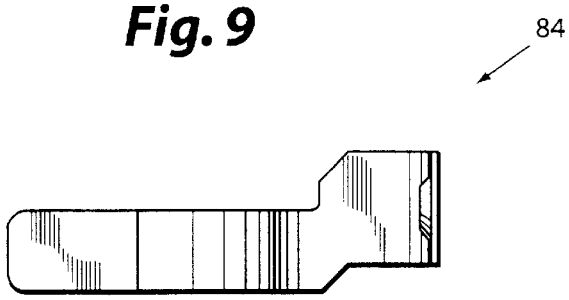
Fig. 10
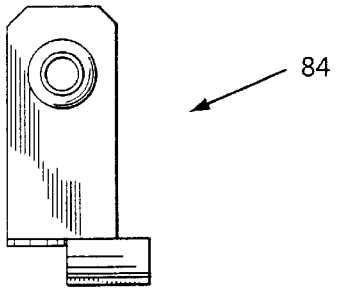
Fig. 8
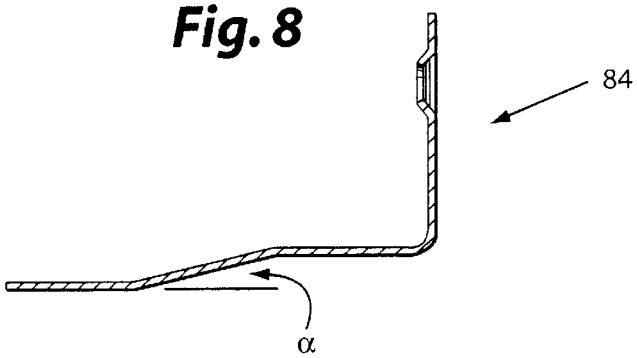
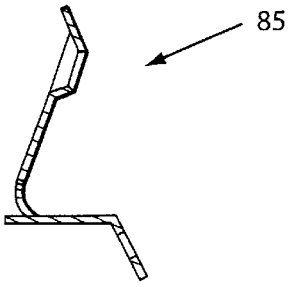
Fig. 11
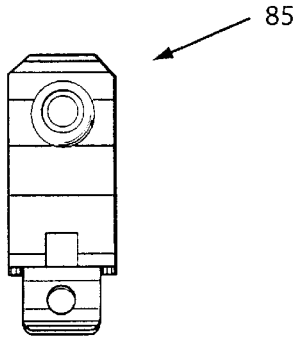
Fig. 12

TOY VEHICLE WITH MOTOR-DRIVEN AND FREE-WHEELING MODES OF USE

BACKGROUND OF THE INVENTION

1. Field of the Invention

This invention relates generally to toy vehicles and, more particularly, to wheeled, battery operated toy vehicles.

2. Description of the Related Art

Toy vehicles are typically adapted to only a single mode of operation. This is because toy vehicles are typically designed to optimally operate in a single end use environment. For example, some toy vehicles are designed as climbing toys and, thus, are intended only to be motor driven. Other types of toys are designed as free-wheeling vehicles which the user pushes, or allows to roll down an incline.

Surprisingly, the simple and desirable free-wheeling mode of use is generally not possible with many powered toy vehicles because the gear train in most toy vehicles is always engaged with the wheels. In such cases it is difficult or impossible for the wheels to rotate in the absence of motor operation and the toys cannot be operated in a true free-wheeling mode.

BRIEF SUMMARY OF THE INVENTION

It is an object of the invention to provide a powered toy vehicle adapted for motor driven, battery powered operation, and in which the wheels can be disengaged from their gear train to permit free-wheeling use.

It is a further object of the invention to provide a toy vehicle in which the motor is disengaged from the power source, e.g., the vehicle battery, in the free-wheeling mode.

It is a further object of the invention to provide a mode selector that is integrated with the power on/off switch.

The foregoing objects are realized in accordance with the invention by providing a toy vehicle adapted for selective motor driven operation and free-wheeling, unpowered push toy use. More specifically, an embodiment of the invention provides a wheeled toy vehicle which may be selectively motor driven or manually driven in a free wheeling mode, which comprises a chassis; at least one laterally extending axle having wheels mounted at each end thereof for rotation therewith; the chassis including a battery receptacle for releasably supporting an electrical battery; an electric motor mounted to the chassis and having a drive shaft extending therefrom at least substantially to at least one axle; a plurality of contact plates for electrically connecting a battery mounted in the battery receptacle to the motor for rotating the drive shaft, and including a first, resilient contact element for resiliently engaging a second contact structure; a gear train for transmitting rotation from the drive shaft to the axle, including a worm for being rotated according to rotation of the drive shaft and a worm gear mounted to the axle, the worm gear being selectively operatively engaged with the worm for being rotated thereby, the axle being freely rotatable relative to the worm when the worm gear is disengaged from the worm; and manually manipulatable switch structure for selectively displacing the worm gear relative to the axle for selectively operatively engaging the worm gear and the worm and selectively disengaging the worm gear from the worm, to selectively transmit rotation of the worm via the worm gear to the axle for motor driven operation and to selectively interrupt transmission of rotation of the worm to the axle for free-wheeling operation, respectively, a portion of the switch structure engaging the resilient contact structure upon lateral displacement of the switch structure to displace the worm gear axially along the axle to disengage said worm gear from said worm, thereby to disengage the first contact structure from the second contact structure and, thereby, electrically disconnect the battery receptacle and the motor.

The invention is also embodied in a wheeled toy vehicle comprising: a chassis having end walls, side walls, and top and bottom walls defining at least one interior compartment; first and second axles having wheels mounted to each longitudinal end thereof mounted to the chassis for rolling rotation; the chassis defining a battery compartment for supporting an electrical battery oriented such that a longitudinal axis thereof extends generally longitudinally of the chassis between the first and second axles; an electric motor mounted in the interior compartment of the chassis and having a drive shaft extending generally longitudinally at least from the motor substantially to the first axle; a worm operatively coupled to the motor shaft so as to be rotated thereby; an output gear selectively operatively coupled to the worm so as to be driven by the worm, the output gear being coaxially mounted to the first axle; a hub fixedly mounted to the first axle; the output gear being axially slidable relative to the first axle from a first position in which the output gear is axially offset from and disengaged from the hub, disengaged from the worm, and rotatable relative to the first axle, and a second position in which the output gear is operatively engaged with the hub and operatively engaged with the worm for transmitting rotation of the worm to the hub structure, thereby to rotate the first axle; mode selecting structure mounted so as to be laterally slidable relative to the drive shaft, the mode selecting structure being engaged with the output gear so that lateral displacement of the mode selecting structure displaces the output gear axially along the first axle into and out of engagement with the hub, the output gear being rotatable relative to the mode selecting structure; and electrical contact structure for selectively transmitting electric power from a battery the in battery compartment to the motor.

In a presently preferred embodiment, lateral displacement of the mode selecting structure to dispose the output gear in the first position interrupts the transmission of electrical power to the motor.

BRIEF DESCRIPTION OF THE DRAWINGS

These, as well as other objects and advantages of this invention, will be more completely understood and appreciated by careful study of the following more detailed description of a presently preferred exemplary embodiments of the invention taken in conjunction with the accompanying drawings, in which:

FIG. 8 is a plan view of the resilient contact shown in FIGS. 6 and 7;

FIG. 9 is another view of the resilient contact taken from above in FIG. 8;

FIG. 10 is another view of the resilient contact taken from the left in FIG. 8;

FIG. 11 is the plan view of the negative terminal plate shown in FIGS. 6 and 7; and FIG. 12 is another view of the negative terminal plate taken from the left in FIG. 11.

DETAILED DESCRIPTION OF THE INVENTION

Figure 1:
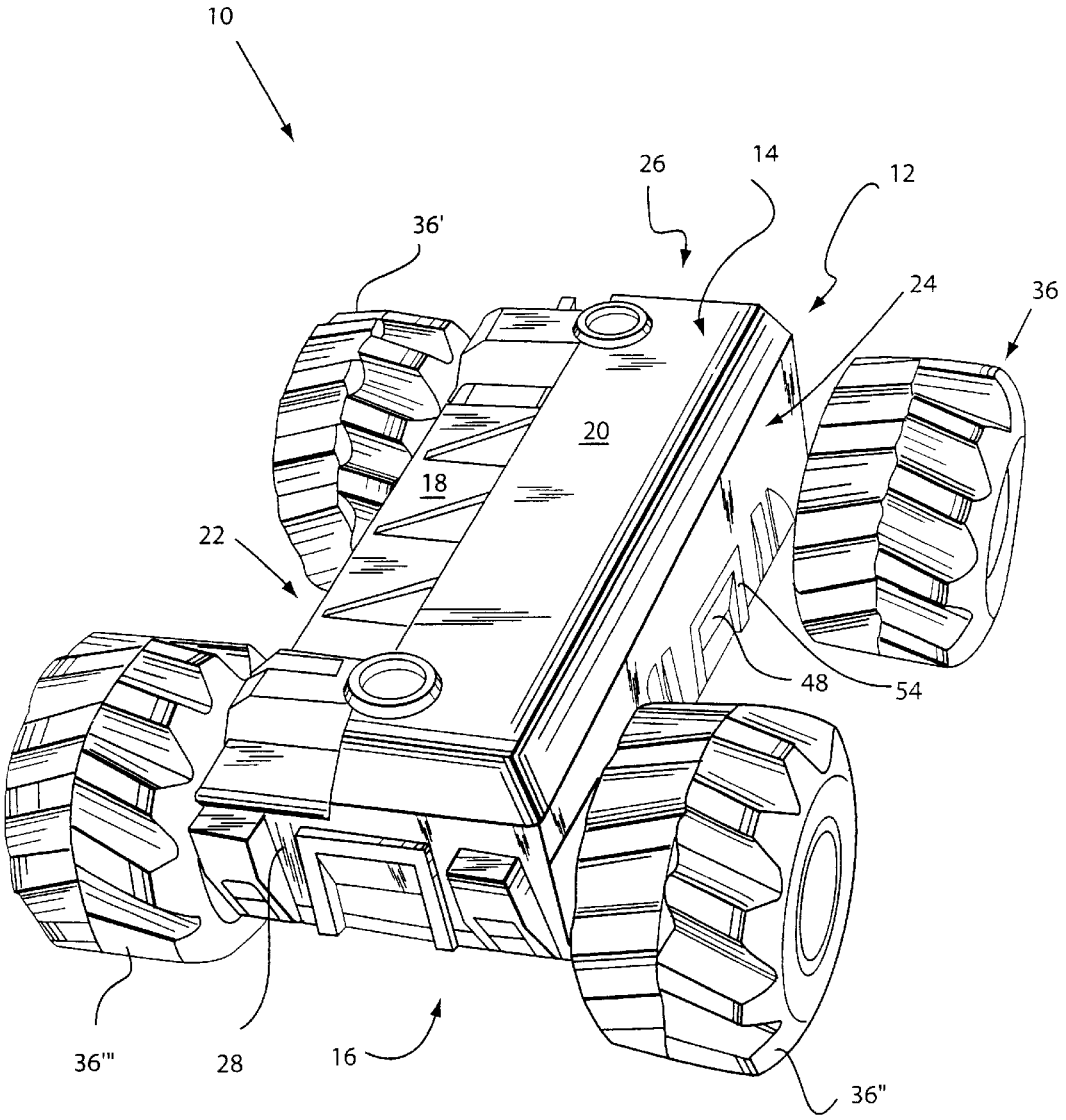
FIG. 1 is a rear, right perspective view, from above, of a toy vehicle provided in accordance with an exemplary embodiment of the invention, shown without a decorative vehicle outer body.

The toy vehicle 10 provided in accordance with an exemplary embodiment of the invention has components assembled in and about a chassis 12 that in the illustrated embodiment is formed from substantially two parts. One part 14 defines a top portion of the chassis 12 and the other part 16 defines a bottom portion of the chassis 12. In the illustrated embodiment, the top portion 14 of the chassis has a top wall 18, 20 of two level configuration, downwardly depending left 22 and right 24 side walls and downwardly depending front 26 and rear 28 end walls. As will become apparent herein below, the two level top wall 18, 20 is for accommodating the battery (not shown) and motor housing 30 in desired dispositions within the chassis 12. The recessed wall 18 overlies the battery compartment whereas the higher elevation wall 20 defines the motor receiving compartment of the chassis 12.

Figure 2:
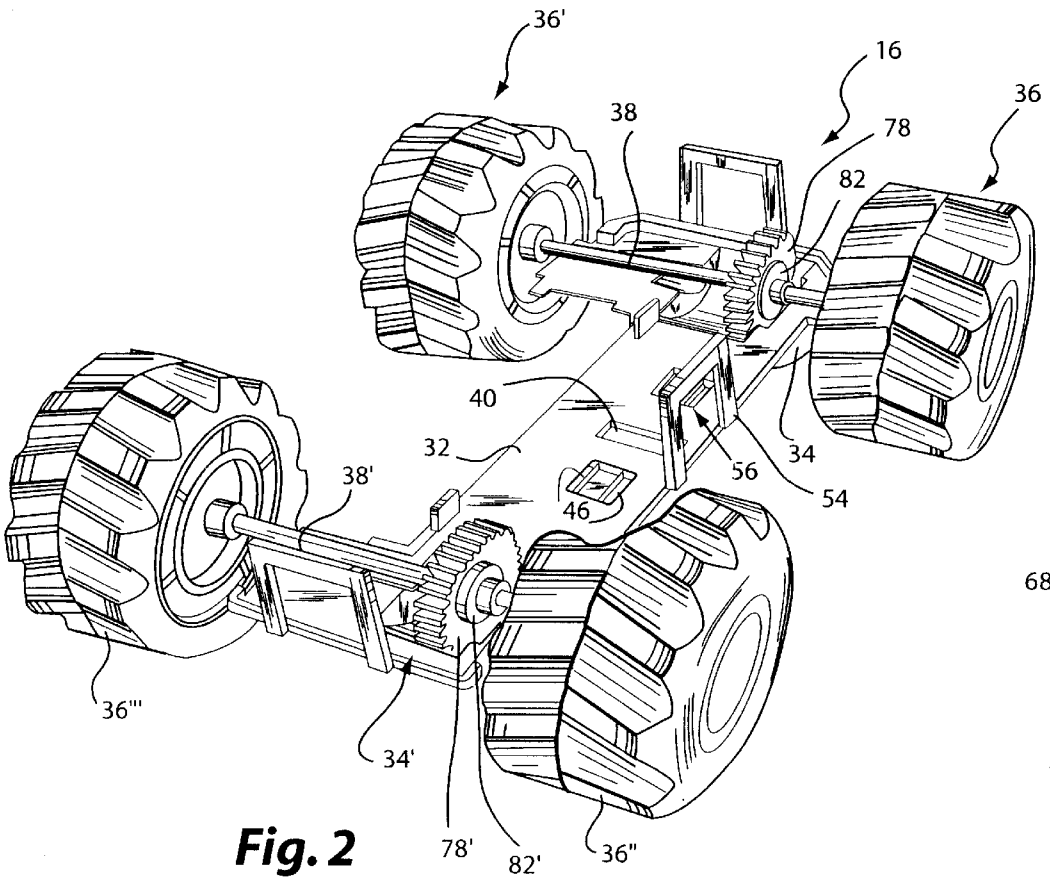
FIG. 2 is a perspective view, from above and the rear, of a bottom portion of the vehicle chassis of FIG. 1, with a portion of the right rear tire broken away.

The bottom portion 16 of the chassis 12 is best shown in FIG. 2. In the illustrated embodiment, the bottom portion 16 is defined by a generally planar wall 32 having recesses 34, 34' for accommodating the worm gears 78, 78' mounted to the front and rear axles 38, 38', as discussed in greater detail below. The bottom portion 16 of the chassis 12 also defines an aperture 40 through which the button 42 of a mode switch plate 44 extends and longitudinal grooves 46 for defining stable positions of the mode switch 44, as also discussed in greater detail below.

Structure is also provided for connecting the upper and lower portions of the vehicle chassis together. In the illustrated embodiment, the upper and lower portions 14, 16 of the chassis 12 are detachably coupled together with structures adapted to snap lock the chassis in its assembled configuration (FIG. 1). Thus, the right side wall 24 of the upper chassis portion 14 (FIGS. 1 and 3) has a projecting flange 48 having an inclined surface 50 and an upper horizontal surface 52 whereas the bottom portion 16 of the chassis has an inverted U-shaped clip structure 54 for being engaged with the flange 48 on side wall 24. When the parts are assembled, the inclined surface 50 of the flange 48 deflects the U-clip 54 outwardly relative to the side wall 24 until the opening 56 defined by the U-clip 54 is aligned with the flange 48, at which point the U-clip 54 snaps into locking engagement with the flange 48. Similar flanges and U-clips are provided on the front 26 and rear 28 end walls of the vehicle chassis 12. Ordinarily these attachment structures are hidden and protected with the vehicle overbody that provides the final ornamental appearance of the toy vehicle.

The vehicle chassis 12 includes a compartment 58 (best shown in FIGS. 6 and 7) for releasibly supporting an electrical battery such, as a AA battery. The compartment is defined by top wall 18, truncated side wall 22, divider wall 70 and interior end walls 72, 74. As shown, the compartment 58 is oriented so that the longitudinal axis of the battery, when supported in the battery compartment 58, extends generally front to back of the vehicle chassis 12, substantially the full distance between the front and rear axles 38, 38' of the vehicle.

In the illustrated embodiment, the battery compartment 58 is accessible from the underside of the chassis and is covered by a detachable L-shaped battery compartment cover 60 engaged with the bottom wall 32 and truncated left side wall 22 of the chassis with suitable tongue and groove or other snap fit coupling structures, as is generally known in the art.

Mounted inside and adjacent the lower wall 32 of the chassis 12 for rotation with respect to it are two parallel but axially spaced apart axles 38, 38', one near the front end 26 and one near the rear end 28 of the chassis. Secured to the ends of these axles are respective pairs of wheels 36, 36'; 36", 36'" for rolling rotation about respective mutually spaced apart axes.

Also mounted within the chassis at a position between the two axles 38, 38' is an electric motor housing 30 with a motor disposed therewithin. The motor housing 30 is suitably secured against longitudinal movement within the chassis body 12 by walls 62, 64. The motor housing is located adjacent the right side wall 24 and is oriented such that its drive shaft 66 is perpendicular to the wheel rotation axes. Upstanding wall 68 is also provided, parallel to walls 62 and 64, for locating the shaft 66 relative to the side wall 24, in the rearward portion of the chassis. In the illustrated embodiment, the motor is of the type having a single drive shaft 66 extending both forwardly and rearwardly from the motor housing 30 and the motor and drive shaft assembly are disposed in generally parallel side by side relation to the battery compartment 58, and the battery when disposed therein. The chassis further includes electric contacts, conductors and switches for selectively electrically connecting the battery to the motor so that the battery powers the motor 30 to rotate the drive shaft 66 to in turn rotate the front and rear axles 38, 38', as discussed in greater detail herein below. Preferably, the motor and battery are connected solely by suitably disposed contact plates 84, 85, as described below with reference to FIGS. 6–12, and thus is a 'no wire' design.

Provided on each end of the drive shaft to rotate therewith are respective worms 76, 76'. Below the worms are respective worm gears 78, 78', each of which is mounted co-axially to the respective wheel axle 38, 38'. For ease of explanation, the particulars of the worm gear(s) and power transmission to the wheel axle(s) will be described with reference to the front worm 76, worm gear 78 and axle 38, it being understood that in the illustrated embodiment a corresponding system is provided at the rear of the vehicle.

Figure 6:
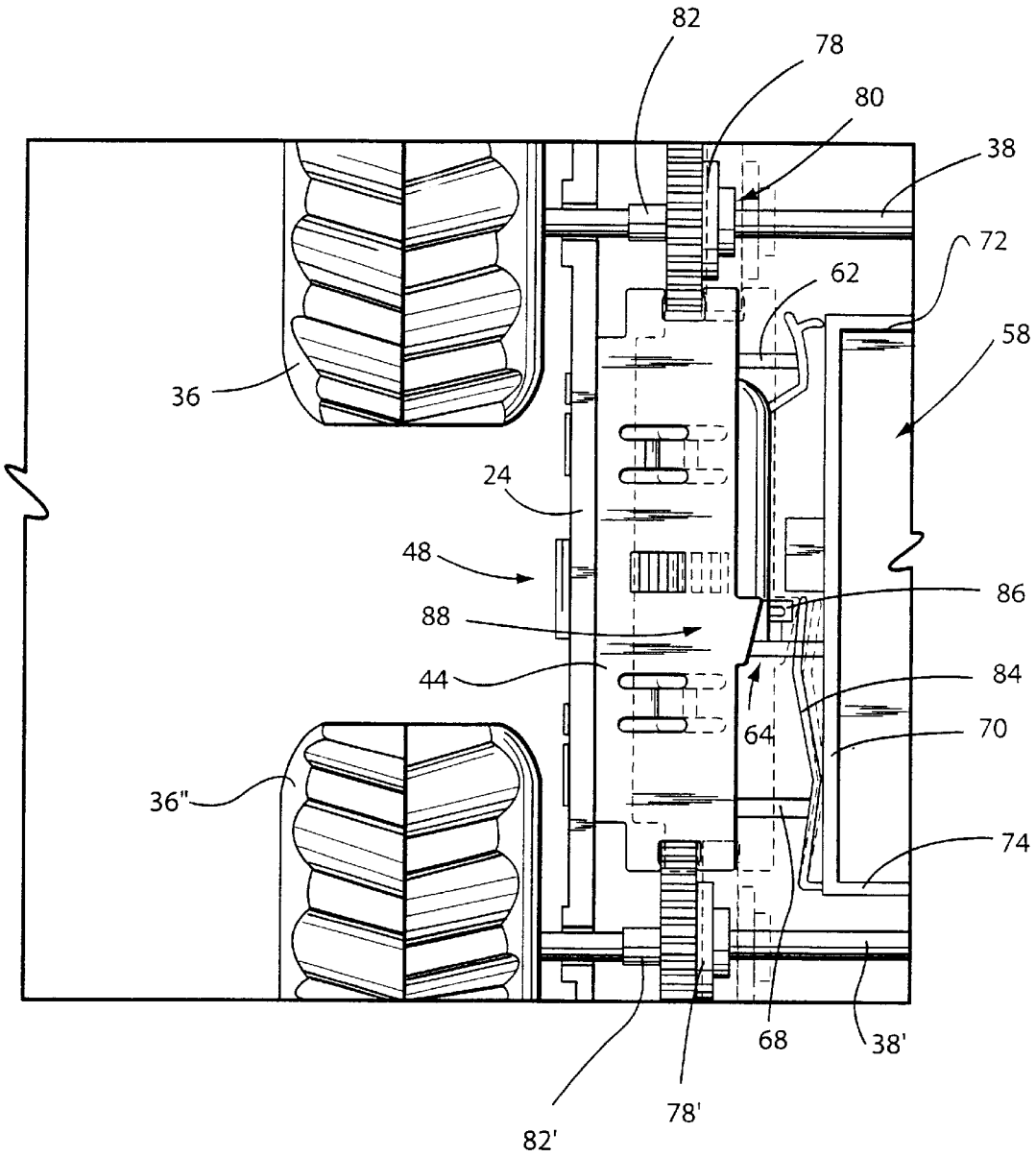
FIG. 6 is a bottom plan view, with the bottom of the chassis omitted, showing the mode switch in accordance with the invention disposed in the power on, motor driven orientation.
Figure 7:
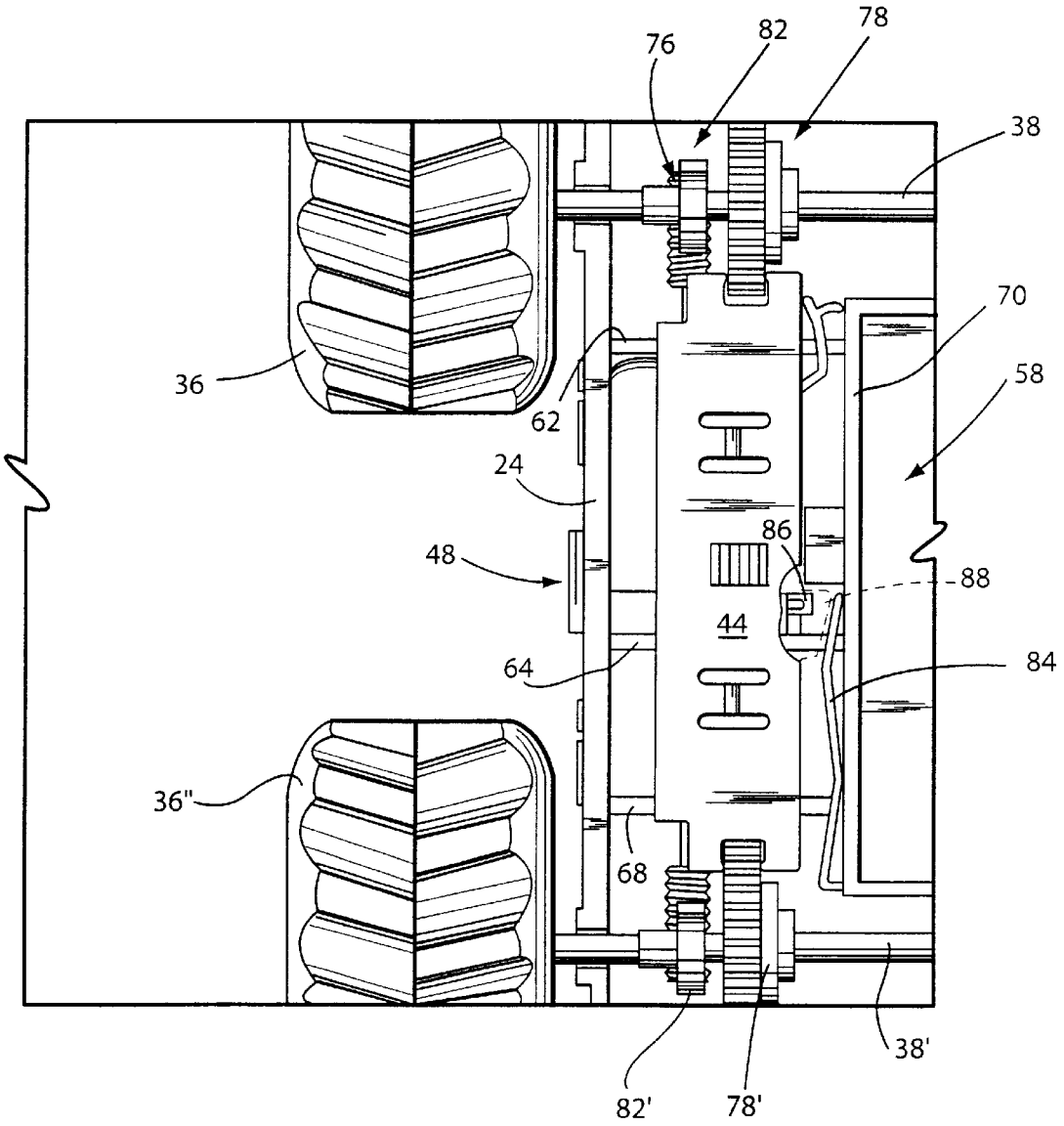
FIG. 7 is a view similar to FIG. 6 showing the mode switch disposed in the power-off, free-wheeling configuration.

The central bore 80 of the worm gear 78 is sized so as to closely approximate the outer diameter of the axle 38 to avoid skewing with respect thereto. However, the worm gear 78 is not fixed to its respective axle 38. Instead, worm gear or output gear 78 is axially displaceable on the axle 38 and relative rotation between the axle and the worm gear 78 is selectively possible. Furthermore, the worm gear 78 defines a clutch outer member which is selectively axially shifted into and out of engagement with a hub 82, defining a clutch inner member, (or clutch element) which is fixedly mounted to the axle 38. When the worm gear 78 is in engagement with the hub 82 (as shown in FIG. 6), the worm gear 78 is locked by hub 82 to the axle 38 so that rotation of the worm gear 78 is transmitted to the axle 38. When the worm gear 78 is axially shifted so as to be disengaged from the hub 82 (as shown in FIG. 7), the axle 38 is free to rotate with respect to the worm gear 78, and vice versa.

Figure 5:
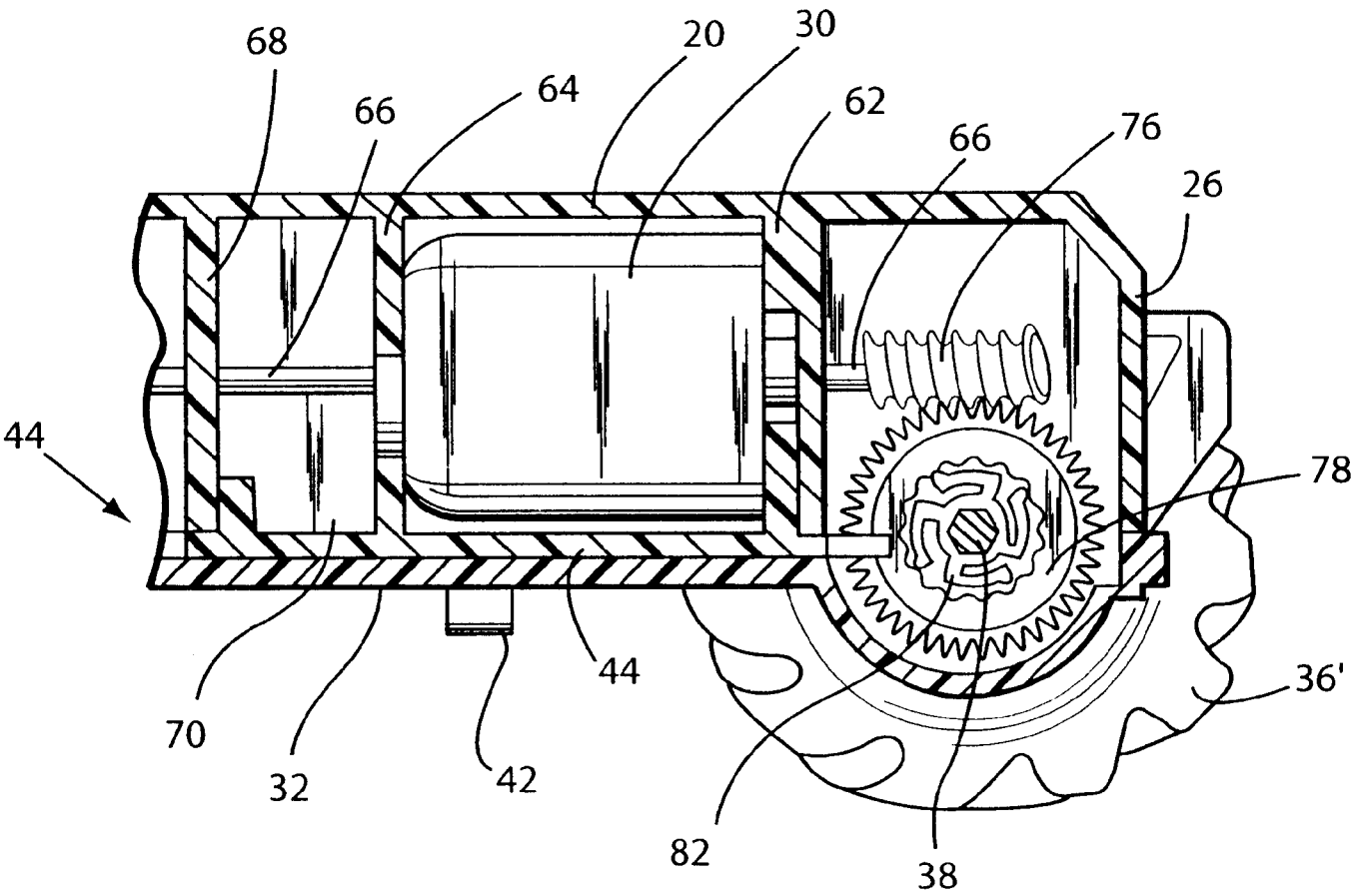
FIG. 5 is a cross-sectional view of a portion of the front of the vehicle chassis, showing a clutch mechanism provided in accordance with the present invention.

For force transmission between the worm gear 78 and the hub 82, the outer surface of the hub 82 has a configuration complementary to the configuration of the confronting surface of the worm gear 78, (as shown in FIG. 5). In the illustrated embodiment, to avoid damage to the motor assembly when the wheel(s) 36, 36' are prevented from rotating, for example if a child holds onto a wheel so that it cannot rotate, the radially facing surfaces of the worm gear 78 and hub 82 define a ratchet and cantilevered pawl, one-way clutch mechanism. Thus, if the wheels/axle cannot rotate, the worm gear 78 can nevertheless rotate about the hub 82 in response to rotation of the worm 76. However, when the worm 76 is operatively engaged with worm gear 78, the toy can not be rolled on its wheels 36, 36' at a speed faster than that dictated by the rotation of the worm gear 78.

As noted above, when the worm gears 78, 78' are axially disengaged from the hubs 82, 82', rotation of the worm gears 78, 78' and of their respective hubs 82, 82' are independent of one another and, thus, free rotation of the axles 38, 38' relative to the worm gears 78, 78', i.e., free wheeling vehicle operation, is possible.

FIGS. 6–10 show a positive terminal resilient contact (e.g. brass plate) 84 for selectively electrically connecting the battery (not shown) to the motor 30. As shown in particular in FIGS. 8–10, resilient contact 84 is uniquely shaped, for example, to include a portion inclined at an angle $\alpha$ of about 15° to facilitate its engagement-disengagement from motor 30 via metal contact 86, as described below.

FIGS. 6, 7 and 11–12 show the negative terminal brass plate 85. In the illustrated embodiment, motor 30 is of negative ground so that the motor housing acts as a negative terminal connected to the negative battery terminal directly through metal contact 85 which is located adjacent the negative battery end (not shown). Contact 85, like resilient contact 84, is bent in such a way as to enable it to be conveniently housed between the battery compartment 58 and the motor compartment and to facilitate direct contact between the battery and the motor ends without the use of any electrical wires.

As can be seen, when the vehicle is switched on, by sliding the on/off/mode switch button 42 and switch plate 44 attached thereto toward right side wall 24 (to the left in FIG. 6), resilient contact 84 engages contact 86, so that the battery powers the motor to rotate the drive shaft 66. When the plate 44 is shifted away from side wall 24 (as shown in phantom lines in FIG. 6), to the position shown in FIG. 7, the resilient contact 84 is engaged by projection 88 (partly broken and shown in phantom in FIG. 7 to reveal contact 86) so as to be disengaged from electrical contact with contact 86. Thus, the battery is disconnected from the motor and the motor is not operational. The switch plate 44 has projections 102 defined on each side of the switch button 42 for being selectively received in one of the two recesses 46 on the bottom wall 32 of the chassis to define the two positions of the switch. In the illustrated embodiment, slots 104 are defined in the switch plate 44 so that the projections 102 can be resiliently flexed to be disengaged from one of the grooves 46 and then snapped into the other.

Figure 3:
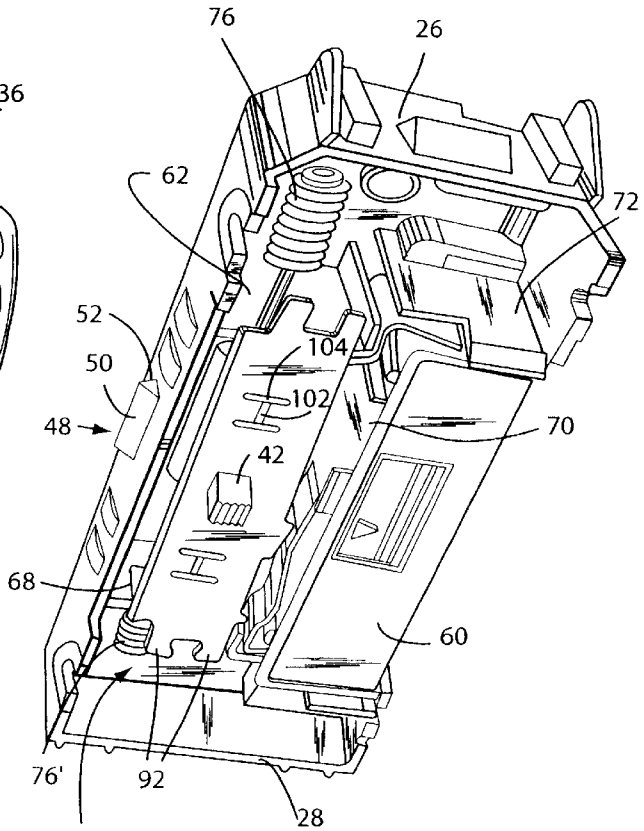
FIG. 3 is a perspective view of a top portion of the vehicle chassis, from below and the front, showing the interior thereof.
Figure 4A:
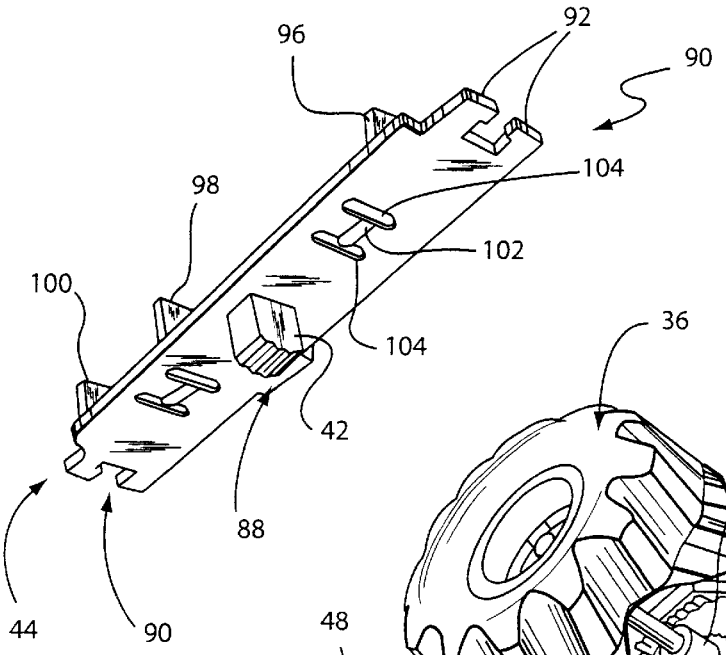
FIG. 4A is a perspective view of the mode switch plate provided in accordance with the invention.
Figure 4:
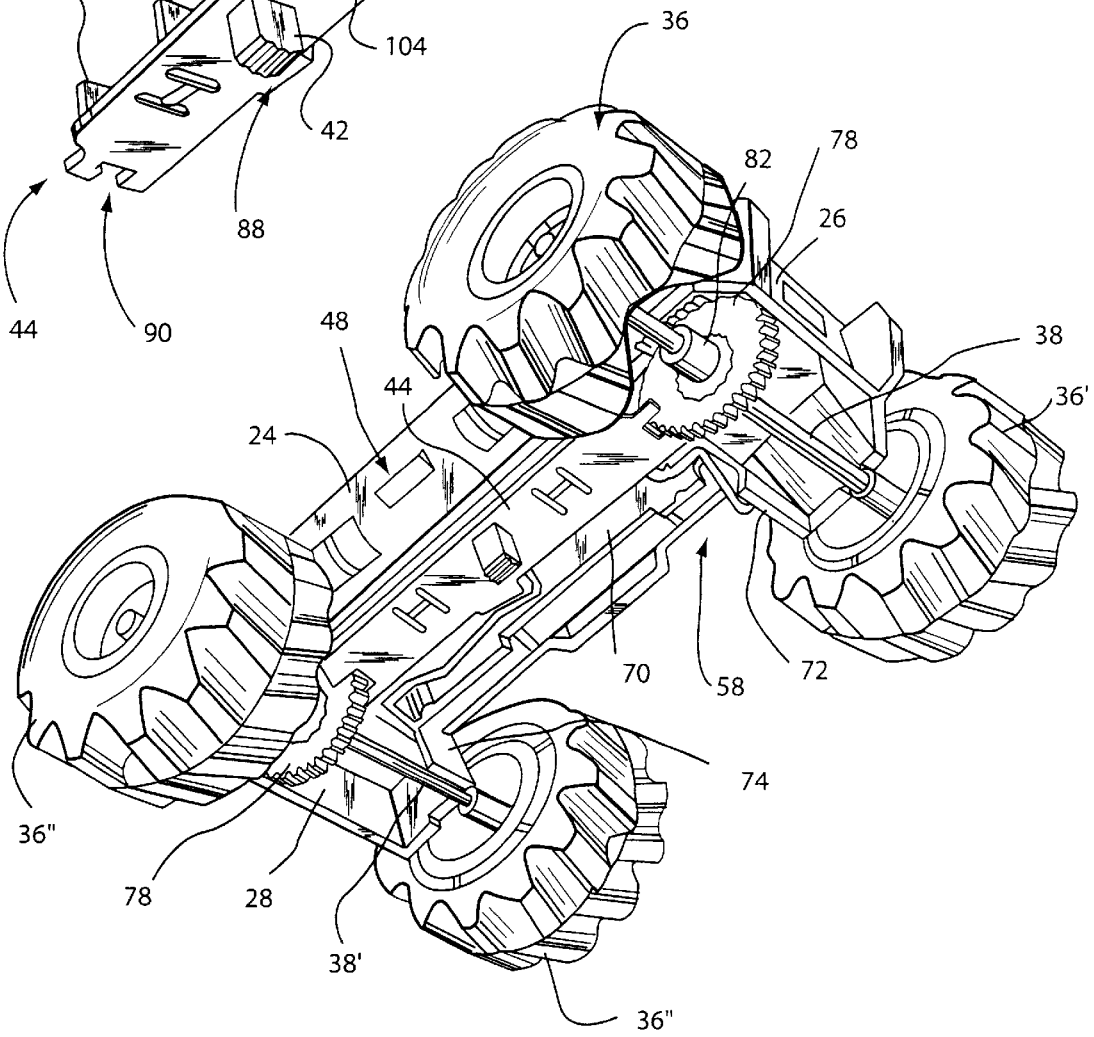
FIG. 4 is a view similar to FIG. 3 with the vehicle wheel assemblies mounted to the vehicle chassis and with a portion of the front right tire broke away.

As shown in FIGS. 3 and 4A, the shifting plate desirably has three wall segments 96, 98, 100 extending perpendicularly thereto for sliding engagement with walls 62, 64 and 68, respectively, to ensure the plate 44 slides along a defined path transverse to the longitudinal axis of the chassis.

As further illustrated in FIGS. 3, 4, 4A, 6 and 7, the switch plate 44 has shifting forks 90 disposed at each longitudinal end thereof, straddling the outer peripheral edges of the worm gears 78, 78' respectively. Each shifting fork 90 includes longitudinally directed segments 92 that together are generally complimentary to configuration of the peripheral edge of the respective worm gear 78, 78' so that the worm gear is free to rotate but will be longitudinally shifted with the shifting plate 44. As noted above, to avoid skewing, each worm gear 78, 78' has a central aperture 80 closely approximating but not identically corresponding to nor snugly engaging the respective axle 38, 38' so that the respective axle can be rotatable relative to the worm gear when the worm gear is disposed as shown in FIG. 7.

Thus, when the mode switch plate 44 and worm gear 78 engaged therewith is shifted to right of the vehicle, to the position shown in FIG. 6, the worm gear 78 engages the respective hub 82 fixedly secured to the respective axle 38 so that the hub and the worm gear will rotate together. Also when the worm gear 78 is shifted to the position shown in FIG. 6, the teeth on the outer periphery of the worm gear 78 are shifted into engagement with the worm 76 provided on the motor drive shaft 66. Finally, substantially at the end of the movement of the switch button 42, resilient contact 84 engages contact 86, so that the battery powers the motor to rotate the shaft 66 to rotate the worm gear 78 engaged therewith, which rotation is in turn translated to the hub 82 and to the axle 38 to which it is fixed, thereby rotating the wheels 36, 36'.

As will be understood from the foregoing, the single manual control button 42 enables selection of or shifting between a motor driven mode in which the wheels are engaged with the gear train so as to be driven by the motor, (FIG. 6) and a free-wheeling mode in which electrical connections are completely interrupted and at the same time, the wheels are disengaged from the gear train for free-wheeling operation (FIG. 7). Thus, the on/off switch for turning the motor on and off simultaneously engages and disengages the gear train.

The structure for selecting the mode of operation is in the form of a sliding switch structure 44 which can be manipulated by a user manually by simple finger pressure so that the vehicle can either be operated as a conventional motor driven toy or in a free rolling, unpowered mode like a push toy. In accordance with the invention, in particular because of the clearance provided by the wheels of the illustrated embodiment, the switch is manually manipulatable by a finger reaching under the vehicle while the vehicle rests upon its four wheels/tires and, thus, the vehicle does not necessarily have to be lifted from the play surface for actuating or de-actuating the motor driven mode.

Although the invention is herein described with reference to an exemplary embodiment as adapted to four wheel drive operation, it is to be understood that the concept of the invention could be adapted to a vehicle having a two wheel drive capability by omitting one of the two worms/worm gears of the illustrated gear train. Moreover, while the illustrated embodiment of the invention has four wheels with, for example, rubber tires mounted to plastic rims, the mode switch mechanism of the invention can be adapted to vehicles having wheels of other configurations and compositions as well as other types of vehicle supporting and driving mechanisms. For example, various types of tires/wheels may be provided incorporating, for example, cleating or padding structures, tank style endless belt assemblies and/or, in a two wheel drive form, skids on the non-driving wheel set.

In the illustrated embodiment, rotation from the drive shaft is directly transmitted to the wheel axle by engagement of the worms defined on the drive shaft to worm gears coupled to the wheel axle. Although not illustrated, in the alternative to a direct connection, a speed reduction mechanism may be provided intermediate the worm and the worm gear, e.g., to provide for transmission of rotation with a mechanical advantage.

While the invention has been described in connection with what is presently considered to be the most practical and preferred embodiment(s), it is to be understood that the invention is not to be limited to the disclosed embodiment, but on the contrary, is intended to cover various modifications and equivalent arrangements included within the spirit and scope of the appended claims.

What is claimed is:

1. A wheeled toy vehicle comprising:

a chassis having end walls, side walls, and top and bottom walls defining at least one interior compartment;

a first axle having first wheels mounted to each longitudinal end thereof, mounted to the chassis for rolling rotation about a longitudinal axis thereof;

a second axle having second wheels mounted to each longitudinal end thereof, mounted to the chassis for rolling rotation about a longitudinal axis thereof;

said chassis defining a battery compartment for supporting an electrical battery oriented such that a longitudinal axis thereof extends generally longitudinally of the chassis between the first and second axles;

an electric motor mounted in the interior compartment of the chassis and having a drive shaft extending generally longitudinally at least from said motor substantially to said first axle;

a worm operatively coupled to said motor shaft so as to be rotated thereby;

an output gear selectively operatively coupled to the worm so as to be driven by the worm, said output gear being coaxially mounted to said first axle;

a hub structure fixedly mounted to said first axle;

said output gear being axially slidable relative to said first axle from a first position in which said output gear is axially offset from and disengaged from said hub structure, disengaged from said worm, and rotatable relative to said first axle, and a second position in which said output gear is operatively engaged with said hub structure and operatively engaged with said worm for transmitting rotation of said worm to said hub structure, thereby to rotate said first axle and said first wheels mounted thereto;

a mode selecting structure mounted so as to be laterally slidable relative to said drive shaft, said mode selecting structure being engaged with said output gear so that lateral displacement of said mode selecting structure displaces said output gear axially along said first axle into and out of engagement with said hub structure, said output gear being rotatable relative to said mode selecting structure; and electrical contact structure for selectively transmitting electric power from a battery said in battery compartment to said motor, wherein said output gear defines a clutch outer member and said hub structure defines a clutch inner member, said clutch outer member having an inner peripheral surface for selectively engaging in a force transmitting manner an outer peripheral surface of said clutch inner member.

2. A wheeled toy vehicle as in claim 1, wherein lateral displacement of said mode selecting structure to dispose said output gear in said first position interrupts said electrical transmission.

3. A wheeled toy vehicle as in claim 2, wherein said mode selecting structure comprises a switch plate disposed generally in parallel to said bottom wall of said chassis, said electrical contact structure includes a first, resilient contact element for resiliently engaging a second contact structure, a portion of said mode selecting structure engaging said resilient contact structure upon lateral displacement of said mode selecting structure to displace said output gear axially along said first axle out of engagement with said hub structure, thereby to disengage said first contact structure from said second contact structure.

4. A wheeled toy vehicle as in claim 1, wherein when said output gear is in said first position, said first axle is substantially freely rotatable relative thereto.

5. A wheeled toy vehicle as in claim 1, wherein said inner peripheral surface of the clutch outer member comprises a plurality of projecting teeth for defining a ratchet structure and said outer peripheral surface of said clutch inner member defines a plurality of resilient pawl elements for lockingly engaging said ratchet teeth.

6. A wheeled toy vehicle as in claim 5, wherein each said resilient pawl element comprises a cantilever member extending part circumferentially and having a radially resilient free end for being engaged with said ratchet teeth, whereby when said clutch inner member is prevented from rotating in response to rotation of the clutch outer member, the clutch outer member rotates relative to the clutch inner member due to the resiliency of said pawls.

7. A wheeled toy vehicle as in claim 1, wherein said drive shaft also extends longitudinally from said motor substantially to said second axle; and said vehicle further comprises:

a second worm operatively coupled to said motor shaft so as to be rotated thereby;

a second output gear selectively operatively coupled to the second worm so as to be driven by the second worm, said second output gear being coaxially mounted to said second axle; and a second hub structure fixedly mounted to said second axle;

said second output gear being axially slidable relative to said second axle from a first position in which said second output gear is axially offset from and disengaged from said second hub structure, disengaged from said second worm, and rotatable relative to said second axle, and a second position in which said second output gear is operatively engaged with said second hub structure and operatively engaged with said second worm for transmitting rotation of said second worm to said second hub structure, thereby to rotate said second axle and said second wheels mounted thereto;

said mode selecting structure being engaged with said second output gear so that lateral displacement of said mode selecting structure also displaces said second output gear axially along said second axle, whereby lateral displacement of said mode selecting structure axially displaces said second output gear into and out of engagement with said second hub structure, said second output gear being rotatable relative to said mode selecting structure.

8. A wheeled toy vehicle as in claim 1, further comprising a locking structure for selectively locking said mode selecting structure in each of two positions corresponding to said first and second positions of said output gear.

9. A wheeled toy vehicle which may be selectively motor driven or manually driven in a free wheeling mode, comprising:

a chassis;

at least one laterally extending axle having wheels mounted at each end thereof for rotation therewith;

the chassis including a battery receptacle for releasably supporting an electrical battery; an electric motor mounted to the chassis and having a drive shaft extending therefrom;

a plurality of contact plates for electrically connecting a battery mounted in the battery receptacle to the motor for rotating the drive shaft, said contact plates including a first, resilient contact element resiliently engaging a second contact structure;

a gear train for transmitting rotation from the drive shaft to said axle, including a worm for being rotated according to rotation of said drive shaft and a worm gear mounted to the axle, said worm gear being selectively operatively engaged with said worm for being rotated thereby, said axle being freely rotatable relative to said worm when said worm gear is disengaged from said worm; and manually manipulatable switch structure for selectively displacing the worm gear relative to said axle for selectively operatively engaging said worm gear and said worm and selectively disengaging said worm gear from said worm, to selectively transmit rotation of the worm via the worm gear to the axle for motor driven operation and to selectively interrupt transmission of rotation of the worm to the axle for free-wheeling operation, respectively, a portion of said switch structure engaging said first, resilient contact element upon lateral displacement of said switch structure to displace said worm gear axially along said axle to disengage said worm gear from said worm, thereby to disengage said first, resilient contact element from said second contact structure and, thereby, electrically disconnect the battery receptacle and the motor, further comprising a clutch element fixedly mounted to said first axle; said switch structure selectively axially displacing said worm gear from a first position in which said worm gear is axially offset from and disengaged from said clutch element and disengaged from said worm, and a second position in which said worm gear is operatively engaged with said clutch element and operatively engaged with said worm for transmitting rotation of said worm via said clutch element to said axle.

10. A wheeled toy vehicle as in claim 9, wherein said switch structure comprises a switch plate disposed generally in parallel to said bottom wall of said chassis.

11. A wheeled toy vehicle as in claim 9, wherein when said worm gear is disengaged from said worm, said axle is substantially freely rotatable relative to said worm gear.

12. A wheeled toy vehicle as in claim 9, wherein displacement of said switch structure to disengage said worm gear from said worm disengages at least a pair of said electrical contacts so as to preclude transmission of electrical power from a battery in the battery receptacle to the electric motor.

13. A wheeled toy vehicle as in claim 9, wherein said worm gear has an inner peripheral surface for selectively engaging in a force transmitting manner an outer peripheral surface of said clutch element.

14. A wheeled toy vehicle as in claim 13, wherein said inner peripheral surface of the worm gear comprises a plurality of projecting teeth for defining a ratchet structure and said outer peripheral surface of said clutch inner member defines a plurality of resilient pawl elements for lockingly engaging said ratchet teeth.

15. A wheeled toy vehicle as in claim 14, wherein each said resilient pawl element comprises a cantilever member extending part circumferentially and having a radially resilient free end for being engaged with said ratchet teeth, whereby when said clutch element is prevented from rotating in response to rotation of the worm gear, the worm gear rotates relative to the clutch element due to the resiliency of said pawls.

16. A wheeled toy vehicle as in claim 9, wherein there are first and second axles, with the motor mounted therebetween;

the drive shaft extends generally transversely to said axles, from the electric motor substantially to each axle;

first and second gear trains transmitting rotation from the drive shaft to said axles, each including a said worm for being rotated according to rotation of said drive shaft and a said worm gear mounted to a respective one of said axles, said worm gears being selectively operatively engaged with said worms for being rotated thereby; and said manually manipulatable switch structure selectively displacing both said worm gears relative to said respective axles for selectively operatively engaging said worm gears and said worms and selectively disengaging said worm gears from said worms for selectively transmitting rotation of the worms via the worm gears to the axles and for selectively interrupting transmission of rotation of the worms to the axles.

17. A wheeled toy vehicle as in claim 9, wherein said first contact structure is disengaged from said second contact structure substantially simultaneous to said disengagement of said worm gear from said worm.

18. A wheeled toy vehicle as in claim 9, wherein said second contact structure is electrically coupled to said motor in the absence of any external electrical wire and said first resilient contact element is electrically connected to said battery mounted in the battery receptacle in the absence of any electrical wire, whereby the battery receptacle is selectively electrically connected to the motor via said first resilient contact element and said second contact structure in the absence of any external electrical wire.

* * * * *